United States Patent [19]

Faessler

[11] Patent Number: 4,499,719

[45] Date of Patent: Feb. 19, 1985

[54] FREED-FIBER SPINNING DEVICES

[75] Inventor: René Faessler, Mulhouse, France

[73] Assignee: Societe Alsacienne de Construction de Materiel Textile, Mulhouse, France

[21] Appl. No.: 527,867

[22] Filed: Aug. 30, 1983

[30] Foreign Application Priority Data

Sep. 8, 1982 [FR] France ..... 82 15213

[51] Int. Cl.[3] ..... D01H 7/882

[52] U.S. Cl. ..... 57/417

[58] Field of Search ..... 57/404, 414, 417, 352

[56] References Cited

U.S. PATENT DOCUMENTS 2,673,442 3/1954 Long ..... 57/334

3,875,731 4/1975 Khomyakov et al. ..... 57/417

FOREIGN PATENT DOCUMENTS 2210684 7/1974 France .

2339006 8/1977 France .

2017167 10/1979 United Kingdom .

*Primary Examiner*—John Petrakes

*Attorney, Agent, or Firm*—Holman & Stern

[57] ABSTRACT

An elbowed yarn exit tube placed at the delivery end of a high-speed hollow rotor contains one or a number of false-twist ribs against which the spun yarn is applied in frictional contact. The ribs form part of a detachable member which is fitted against the periphery of a recess formed in the elbowed portion of the exit tube in the zone nearest the generator-line which has the shortest radius of curvature, the detachable member being locked in position by means of a slidable retaining sleeve.

7 Claims, 4 Drawing Figures

FREED-FIBER SPINNING DEVICES

BACKGROUND OF THE INVENTION

1. Field of the Invention

This invention relates to freed-fiber spinning devices of the type comprising a hollow rotor which rotates at high speed, the yarn being delivered in the geometrical axis of said rotor, and a false-twist rib placed within an elbowed portion of an exit tube of the rotor. The elbowed portion of the exit tube is subjected to the partial vacuum which prevails within the rotor and has a direction such that the path of the textile yarn is modified as it passes against the above-mentioned rib under the action of takeup means and that the rib extends across the geometrical plane formed by the two lengths of yarn upstream and downstream of said rib.

In more precise terms, the invention relates to the structure of the elbowed exit tube of the rotor and to the design of the false-twist rib placed within said exit tube.

2. Description of the Prior Art

As already disclosed, for example, in British Patent Specification No. 2017167 published Oct. 3, 1979, assigned to the same assignee of this application, and French patent No. 2,210,684 dated July 12, 1974 similarly assigned, it is known to design the false-twist rib in the form of a portion of a turn of wire which is wound in a helix and forcibly inserted in the elbowed tube. While this structure proves satisfactory insofar as it achieves the desired result, namely a temporary increase in twist of the textile yarn for improving the spinning process, it is open to criticism on the ground of excessively rapid wear of the turn of wire against which the textile yarn is continuously applied in rubbing contact at high speed. Furthermore, the replacement of a worn helical wire by a new wire element is not a convenient operation.

BRIEF SUMMARY OF THE INVENTION

The object of the invention is to provide an assembly which consists of a yarn exit tube and false-twist rib but which is not attended by the disadvantage of the known device referred-to above.

To this end, and in accordance with the invention, the false-twist rib forms part of a detachable member which is fitted in position against the periphery of a recess formed in the elbowed portion of the yarn exit tube in the zone of the generator-line having the shortest radius of curvature of said elbowed portion of the tube, said deformable member being stationarily fixed by suitable retaining means.

By virtue of this particular structure, when the false-twist rib beings to exhibit a certain degree of wear, it can be replaced by a new rib without the least difficulty. In particular, no component of the spinning unit has to be disassembled since the detachable member which carries the worn rib need only be released from the elbowed tube and replaced by a new member. From a practical standpoint, the ease with which this replacement operation can be performed is conducive to an improvement in the quality of the spun yarn thus obtained since there is no reason to hesitate over the need to carry out this replacement as soon as the slightest wear of the rib becomes perceptible.

In an advantageous embodiment, the means for retaining the detachable element are constituted by a flexible sleeve engaged in a fairly tight sliding fit over the elbowed portion of the yarn exit tube so as to cover said detachable member with a substantial overlap. Thus, in order to remove the detachable member, it is only necessary to slide the flexible sleeve along the tube over a sufficient distance to uncover the detachable member. After positioning of another detachable member, the sleeve is returned to its initial position, with the result that the new member is locked in position.

BRIEF DESCRIPTION OF THE DRAWINGS

Other features of the invention will be more apparent upon consideration of the following description and accompanying drawings, wherein.

DETAILED DESCRIPTION

Figure 1:
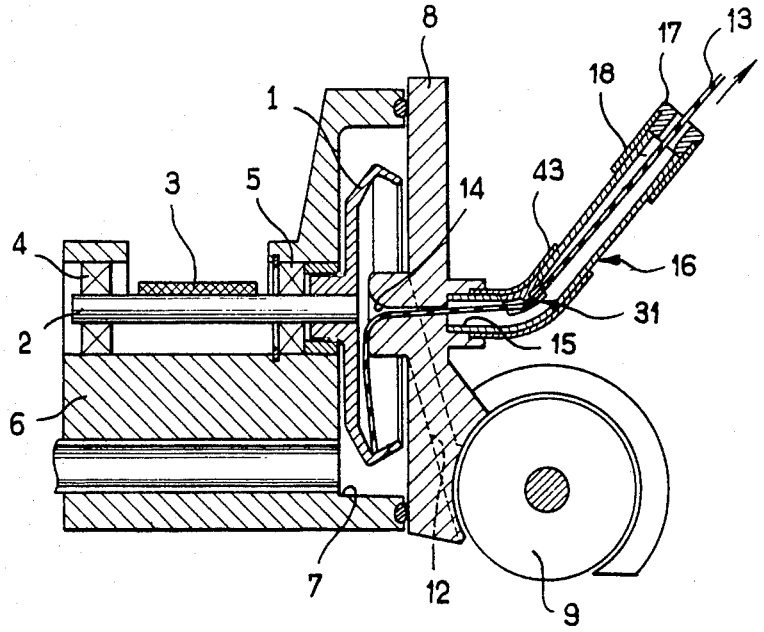
FIG. 1 is a longitudinal cross-sectional view of a freed-fiber spinning device equipped with a false-twist member in accordance with the invention.

The freed-fiber spinning device shown in FIG. 1 is of a conventional type. It essentially comprises a hollow rotor 1 and a shaft 2 driven in rotation at high speed by a friction belt 3 and rotatably mounted by means of two ball-bearings 4, 5 within a body 6 having a cavity 7 in which said rotor is housed. Said cavity is closed by a cover 8 which is adapted to carry a device for supplying non-continuous fibers 9. Said fibers are fed tangentially into the rotor 1 via an oblique duct 12 which extends through the cover 8 whilst the yarn 13 obtained is delivered via a central duct 14 which also extends through the cover 8, coaxially with the rotor. In the vicinity of its outlet end, the duct 14 has an enlarged portion 15 in which is forcibly fitted the upstream or proximal end of a yarn exit tube 16, the downstream or distal end of which is provided with an eyelet 17 having high abrasion resistance. Said eyelet is tightly fitted and bonded within a sleeve 18 of plastic material, for example, said sleeve being in turn tightly fitted over the downstream end of the exit tube 16.

Figure 2:
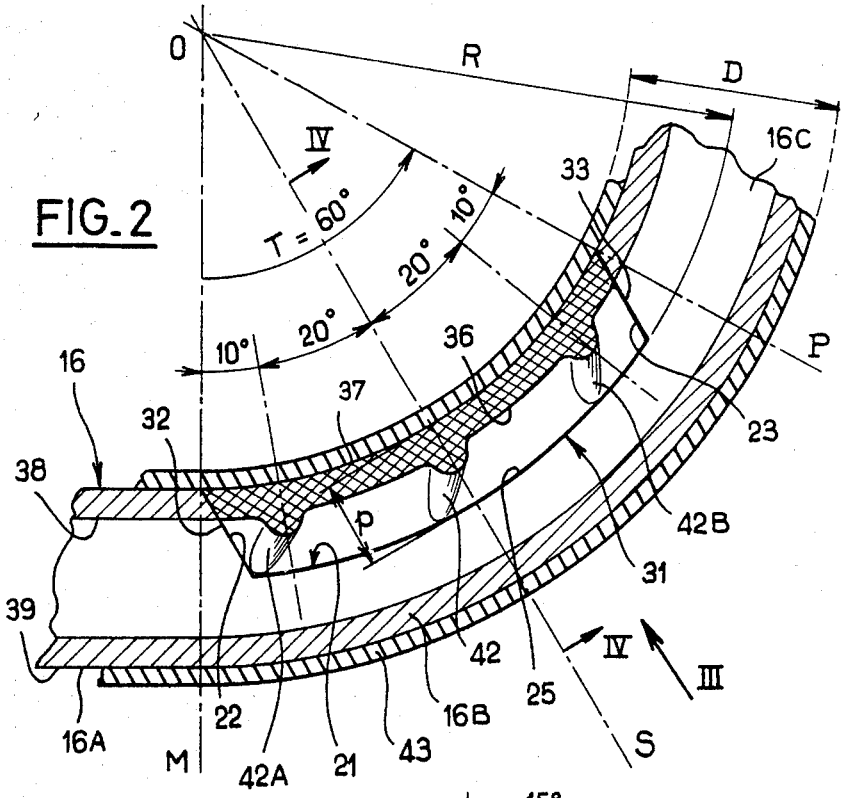
FIG. 2 is a cross-sectional view on a larger scale showing the detail of FIG. 1 which represents the portion equipped with the false-twist member.

The yarn exit tube 16 is made up of three portions, namely a rectilinear upstream portion 16A (as shown in FIG. 2), an elbowed portion 16B, and a rectilinear downstream portion 16C. Said portions are delimited by a first geometrical plane OM at right angles to the upstream portion of the tube, that is to say at right angles to the axis of the rotor 1, and by a second geometrical plane OP which forms with the first plane a dihedral angle "T" of the order of 60° in the example shown. The point O which represents the edge or arris of the dihedral angle constitutes the center of curvature of the elbowed portion of the tube 16.

A recess 21 of elongated shape is formed in the elbowed portion 16B of the yarn exit tube 16, starting from the generator-line of said tube which has the shortest radius of curvature. Said recess 21 is delimited on the one hand in length by two faces 22, 23 which are substantially parallel to the geometrical plane OS bisecting the dihedral angle "T", on each side of and at an equal distance from said plane. The intersections of the two faces 22, 23 of the recess with the generator-line of said tube 16 which has the shortest radius of curvature are located respectively in the two faces OM and OP of the dihedral angle "T". The recess 21 is also limited in depth by a cylindrical geometrical surface 25 whose axis coincides with the axis O of curvature of the elbowed portion 16B of the exit tube and whose radius is equal to the mean radius R of curvature of the tube in this example. In other words, the depth "p" of the recess is equal to one-half the external diameter "D" of the yarn exit tube.

Figure 3:
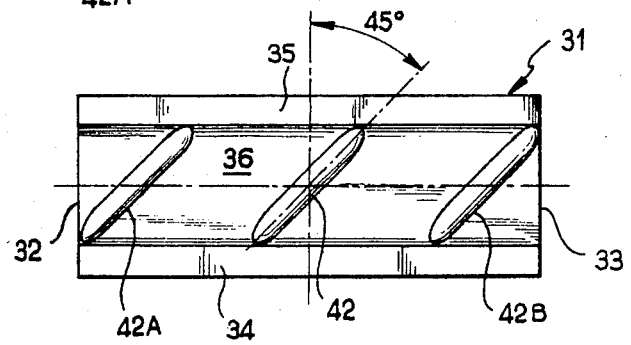
FIG. 3 is an internal view in elevation showing the detachable member, looking in the direction of the arrow III of FIG. 2.
Figure 4:
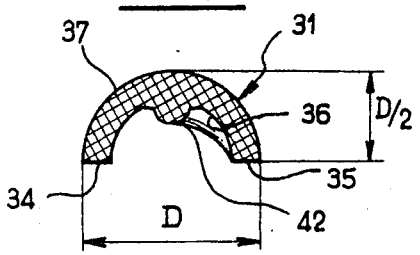
FIG. 4 is a transverse cross-sectional view of the detachable member taken along line IV—IV of FIG. 2.

A detachable member 31 having a configuration which corresponds to that of the recess 21 is engaged in a tight fit within the recess. Said member 31 therefore has two end faces 32, 33 respectively which are engaged against the two corresponding end faces 22, 23 of the recess and two longitudinal faces 34, 35 respectively (as also shown in FIGS. 3 and 4), said longitudinal faces being engaged against the corresponding longitudinal faces of the recess which coincide at 25 in FIG. 2. The inner surface 36 and outer surface 37 of the detachable member 31 therefore ensure continuity respectively of the inner surface 38 and outer surface 39 of the exit tube 16, namely the surfaces which are interrupted by the recess 21.

A false-twist rib 42 having a rounded cross-section and integral with the detachable member 31 in the example shown projects from the central portion of the inner face of said detachable member and has the shape of a portion of a helical turn which is preferably inclined at an angle of 45°. In the example illustrated, said rib extends practically over the entire circumference of the detachable member, that is to say substantially over a half-circumference. In one embodiment which has produced good results, the extent of projection of the rib within the interior of the detachable member is of the order of 0.8 mm whereas said member has an internal diameter of 4 mm.

The detachable member 31 is formed of material which has high abrasion resistance under the action of a textile thread which passes against it and is preferably of ceramic material such as sintered alumina, for example. Said member is held in position by any suitable retaining means. In the case shown in the drawings, said retaining means consist of a cylindrical sleeve 43 of flexible and elastic material such as superpolyamide, for example, which applies the member in air-tight manner against the faces of the tube recess. Said sleeve is engaged over the tube 16 in a fairly tight sliding fit and overlaps the detachable member to a substantial extent.

In an advantageous embodiment of the type which is illustrated, the detachable member 31 is provided with two additional false-twist ribs 42A, 42B which are identical with the rib 42 and placed symmetrically on each side of said rib, thus making a total of three ribs. There is, however, no implied limitation in the number of false-twist ribs which may be provided. As represented on FIG. 2, the two additional false-twist ribs 42A–42B might be located approximately 20° on both sides of the central rib 42, the dihedral angle T of the detachable member extending about 60°.

The operation of the device is as follows:

The elbowed tube 16 is subjected to the partial vacuum which prevails within the rotor 1, with the result that the spinning process may conveniently be initiated by introducing a yarn end into the elbowed tube 16 through the eyelet 17. Said yarn end is sucked towards the rotor 1 and passes readily into the elbowed portion 16B of the tube by reason of the fact that the false-twist rib 42 is inclined and extends only over one-half of the circumference of the tube whereas the other half is perfectly smooth.

When the spinning process has been initiated, the textile yarn 13 is drawn by conventional takeup means (not shown in the drawings) and consequently tends to be applied against the generator-line having the shortest radius of curvature of the elbowed portion 16B of the tube. The yarn therefore slides successively against the inclined ribs 42A, 42 and 42B and is subjected by frictional contact with these ribs to a reaction which has the effect of temporarily increasing its torsion as a result of a false-twist phenomenon which is subsequently lost as it passes out of the elbowed tube 16 but which has had the time to assist the spinning process and to improve the quality of the yarn as is already known. It will readily be apparent that the direction of slope of the false-twist ribs corresponds to the direction of twist of the yarn. By rubbing against the false-twist ribs, the yarn is not liable to be damaged since these ribs have a rounded cross-section.

In spite of the fact that the material constituting the false-twist ribs is endowed with special resistance, a certain degree of wear finally develops on the ribs during operation but they can very readily be replaced as often as may be desired. To this end, it is only necessary to slide the retaining sleeve 43 towards the distal end of the elbowed tube 16. The detachable member which has thus been released can then be withdrawn from the recess 21 and replaced by a new member. The retaining sleeve 43 is then moved back to its initial position in which it serves both to hold the detachable member in position and to ensure air-tightness of the assembly, thus preventing any loss of vacuum within the spinning rotor 1.

What is claimed is:

1. In a freed-fiber spinning device having a hollow rotor mounted for high speed rotation and being subjected to a partial vacuum in its hollow interior, means for delivering textile yarn from the interior of said rotor along the geometrical axis of the rotor, a yarn exit tube having an entrance end communicating with said yarn delivering means and the partial vacuum in said rotor for receiving the yarn therein, take-up means for drawing the yarn through the exit tube, and an elbowed portion in said yarn exit tube for modifying the direction of the path of the yarn as it passes through the exit tube, the improvement comprising;

a recess penetrating through the elbowed portion of the yarn exit tube in the zone of the generator-line having the shortest radius of curvature of said elbowed portion;

a detachable member having a configuration identical with the configuration of the portion of the tube removed to form said recess so that the detachable member fits in position against the periphery of said recess and has inner and outer surfaces ensuring respectively the continuity of the inner and outer surfaces of said exit tube interrupted by said recess;

a false-twist rib integrally formed in one piece with said detachable member and extending thereon across the geometrical plane formed by a length of yarn upstream and a length of yarn downstream of said rib so that said rib is disposed within said yarn exit tube and said yarn passes against said rib as it is drawn through the exit tube by said take-up means:

said false-twist rib having a rounded cross-section against which said yarn passes; and a removable retaining means for stationarily fixing said detachable member in said recess.

2. A device as claimed in claim 1 wherein:

said recess is delimited in length by two flat end faces lying in planes which form a dihedral angle whose edge is located on the axis of curvature of said elbowed portion, said faces being substantially parallel to the plane which bisects said dihedral angle; and said recess is delimited in depth by a cylindrical geometric surface having an axis of curvature which coincides with the axis of curvature of said elbowed portion.

3. A device according to claim 2, wherein:

said depth of the recess is equal to one-half the external diameter of the yarn exit tube.

4. A device according to claim 2 or claim 3, wherein said removable retaining means comprises:

a flexible sleeve engageable over the elbowed portion of the yarn exit tube in a fairly tight sliding fit and adapted to cover said detachable member with a substantial overlap.

5. A device according to claim 2, wherein:

said dihedral angle is of the order of 60°; said false-twist rib is located at the mid-point of the length of said detachable member; and further comprising two additional false-twist ribs having the same characteristics as said mid-point false-twist rib and located respectively at approximately 20° upstream and 20° downstream with respect to said mid-point false-twist rib.

6. A device according to claim 1, wherein said detachable member is formed of sintered alumina ceramic material.

7. A device according to claim 1, and further comprising:

at least one additional false-twist rib on said detachable member having the same characteristics as said first mentioned false-twist rib and located upstream and/or downstream of said false-twist rib.

* * * * *